United States Patent [19]

Cha

[11] 4,223,726

[45] Sep. 23, 1980

[54] DETERMINING THE LOCUS OF A PROCESSING ZONE IN AN OIL SHALE RETORT BY EFFLUENT WATER COMPOSITION

[75] Inventor: Chang Y. Cha, Bakersfield, Calif.

[73] Assignee: Occidental Oil Shale, Inc., Grand Junction, Colo.

[21] Appl. No.: 16,459

[22] Filed: Feb. 28, 1979

Related U.S. Application Data

[63] Continuation of Ser. No. 867,642, Jan. 6, 1978, abandoned.

[51] Int. Cl.[2] ..... E21B 43/24; E21B 47/00

[52] U.S. Cl. ..... 166/251; 299/2; 166/259

[58] Field of Search ..... 166/251, 259, 252, 256, 166/302, 64; 299/2–4

[56] References Cited

U.S. PATENT DOCUMENTS

| | | | |
|---|---|---|---|
| 3,072,184 | 1/1963 | Parker | 166/251 |
| 3,454,365 | 7/1969 | Lumpkin et al. | 166/251 UX |
| 3,467,189 | 9/1969 | Dingley | 166/251 |
| 4,007,963 | 2/1977 | Ridley | 166/259 X |
| 4,082,145 | 4/1978 | Elkington | 166/251 |

*Primary Examiner*—Stephen J. Novosad
*Attorney, Agent, or Firm*—Arnold Grant

[57] ABSTRACT

A processing zone advances through a fragmented permeable mass of particles containing oil shale in an in-situ oil shale retort in a subterranean formation containing oil shale. The retort has an effluent water passing therefrom. The effluent water carries a constituent which is formed, by advancement of the processing zone through the fragmented mass, from a precursor contained in the formation. In a first aspect of the invention, the locus of the processing zone is determined by assaying the formation at selected locations in the retort for content of the precursor before processing the selected locations, and effluent water from the retort is monitored for concentration of the selected constituent. For example, the nitrogen content of kerogen can be the precursor and effluent water from the retort can be monitored for the concentration of ammonia and/or ammonium sulfate produced by retorting of kerogen in the oil shale. In the second embodiment of the invention, recognition is made of the correlation between the Fischer Assay of the oil shale and the amount of water it contains. Core samples of the formation are analyzed prior to processing to determine the water content and the predicted water production rate due to the passage of a processing zone through that location in the formation. Actual water production rate can then be compared with the predicted rate and the locus of the processing zone determined.

30 Claims, 1 Drawing Figure

Figure 1:
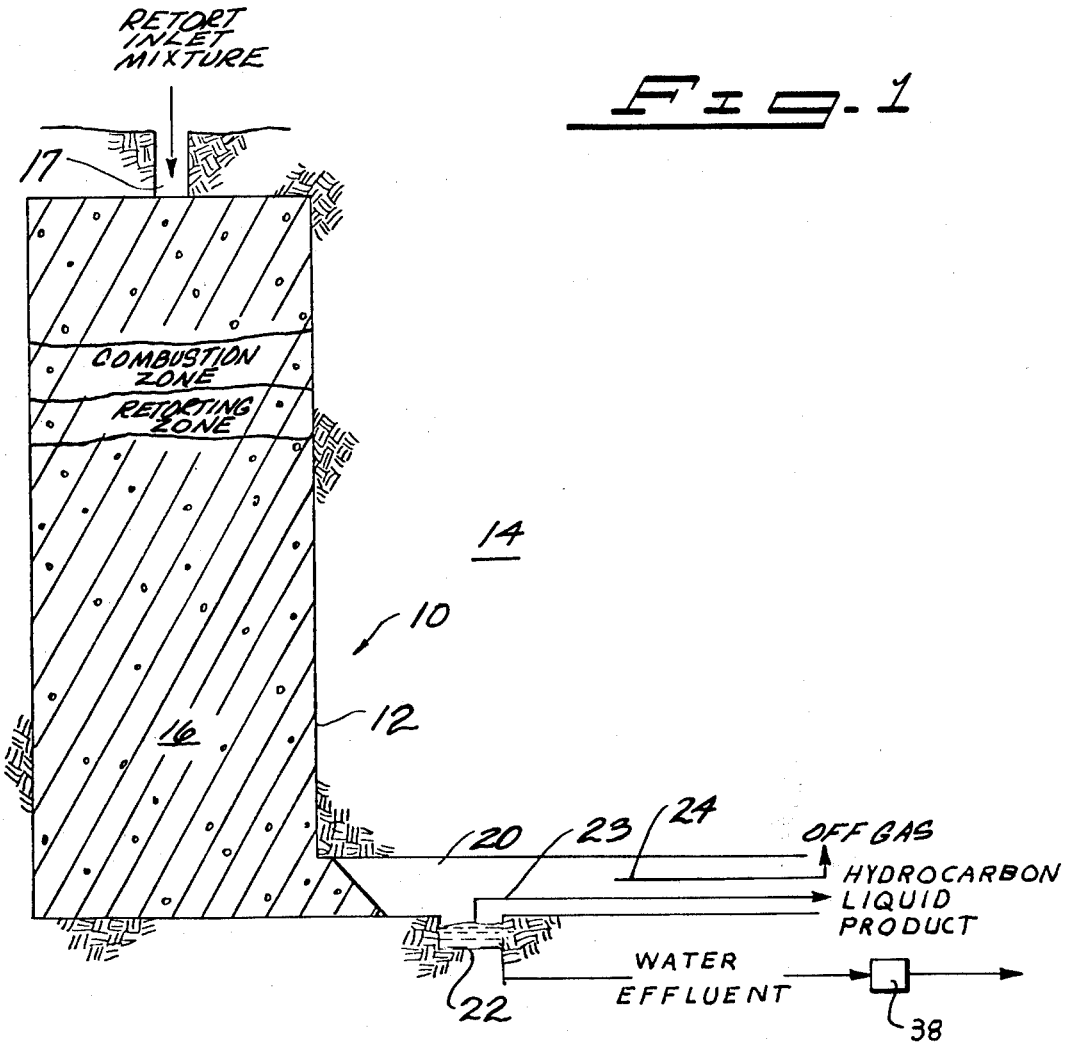

DETERMINING THE LOCUS OF A PROCESSING ZONE IN AN OIL SHALE RETORT BY EFFLUENT WATER COMPOSITION

This is a continuation of application Ser. No. 867,642, filed Jan. 6, 1978, now abandoned.

BACKGROUND

The presence of large deposits of oil shale in the Rocky Mountain region of the United States has given rise to extensive efforts to develop methods of recovering shale oil from kerogen in the oil shale deposits. It should be noted that the term "oil shale" as used in the industry is in fact a misnomer; it is neither shale nor does it contain oil. It is a sedimentary formation comprising marlstone deposit having layers containing an organic polymer called "kerogen", which upon heating decomposes to produce hydrocarbon liquid and gaseous products. It is the formation containing kerogen that is called "oil shale" herein, and the liquid hydrocarbon product is called "shale oil".

A number of methods have been proposed for processing oil shale which involve either first mining the kerogen bearing shale and processing the shale above ground, or processing the oil shale in-situ. The latter approach is preferable from the standpoint of environmental impact since the spent shale remains in place, reducing the chance of surface contamination and the requirement for disposal of solid wastes.

The recovery of liquid and gaseous products from oil shale deposits has been described in several patents, one of which is U.S. Pat. No. 3,661,423, issued May 9, 1972 to Donald E. Garrett, assigned to the assignee of this application and incorporated herein by this reference. This patent describes in-situ recovery of liquid and gaseous hydrocarbon materials from a subterranean formation containing oil shale by mining out a portion of the subterranean formation and then fragmenting a portion of the remaining formation to form a stationary, fragmented permeable mass of formation particles containing oil shale, referred to herein as an in-situ oil shale retort. Hot retorting gases are passed through the in-situ oil shale retort to convert kerogen contained in the oil shale to liquid and gaseous products.

One method of supplying hot retorting gases used for converting kerogen contained in the oil shale, as described in U.S. Pat. No. 3,661,423, the disclosure of which is incorporated herein by reference, includes establishment of a combustion zone in the retort and continued introduction of an oxygen containing retort inlet mixture into the retort to advance the combustion zone through the retort. As used herein the term "combustion zone" is used to indicate that zone in the retort in which the major portion of the oxygen in the oxygen containing retort inlet mixture is depleted by reaction with hot carbonaceous materials to produce heat and combustion gas. The combustion zone is maintained at a temperature lower than the fusion temperature of oil shale, which is about 2100° F., to avoid plugging of the retort, and above about 1100° F. for efficient recovery of hydrocarbon products from the oil shale.

The effluent gas from the combustion zone, which is essentially free of free oxygen and comprises combustion gas, carbon dioxide from mineral carbonate decomposition, and any gaseous portion of the combustion zone feed that does not take part in the combustion process, advances through the retort to the retorting zone. As used herein the term "retorting zone" refers to that portion of the retort on the advancing side of the combustion zone wherein the effluent gas from the combustion zone heats the oil shale to a temperature sufficient to produce kerogen decomposition, called retorting, in the oil shale to gaseous and liquid products and to a residue of solid carbonaceous material.

The term "processing zone" refers herein to either a combustion zone, a retorting zone, or both a retorting zone and combustion zone, in an in situ oil shale retort; and, the term "processing gas" is used to indicate a gas which serves to advance a processing zone and includes, but is not limited to, an oxygen supplying gas introduced into a retort for advancing a combustion zone and retorting zone through a retort and a hot retorting gas which can be introduced into a retort or generated in a combustion zone in a retort for advancing a retorting zone through a retort.

The liquid products and gaseous products are cooled by cooler particles in the fragmented mass in the retort on the advancing side of the retorting zone. The liquid hydrocarbon products, together with water produced in or added to the retort, are collected at the bottom of the retort and withdrawn to the surface through an access tunnel, drift or shaft where they are separated. An effluent gas, referred to herein as off gas, containing combustion gas generated in the combustion zone, gaseous products, carbon dioxide from carbonate decomposition, and any gaseous portion of the combustion zone feed that does not take part in the combustion process is also withdrawn from the bottom of the retort.

There are several reasons why it is necessary to know the locus of parts of the combustion and retorting zones as they advance through an in situ oil shale retort. One reason is that by knowing the locus of the combustion zone, steps can be taken to control the orientation or shape of the advancing side of the combustion zone. It is desirable to maintain a combustion zone which is flat and uniformly transverse and preferably uniformly normal to the direction of its advancement. If the combustion zone is skewed relative to its direction of advancement, there is more tendency for oxygen present in the combustion zone to oxidize hydrocarbon products produced in the retorting zone, thereby reducing hydrocarbon yield. In addition, with a skewed or warped combustion zone, more cracking of the hydrocarbon products can result. Monitoring the locus of parts of the combustion zone provides information for control of the advancement of the combustion zone to maintain it flat and uniformly perpendicular to the direction of its advancement to obtain high yield of hydrocarbon products.

Another reason to monitor the locus of the combusion zone is to provide information so the composition of the combustion zone feed can be varied with variations in the kerogen content of oil shale being retorted. Formations containing oil shale include horizontal strata or beds of varying kerogen content. If the concentration of oxygen introduced into a region of the retort is too high for the kerogen content in that region, oxidation of carbonaceous material in the oil shale can generate so much heat that fusion of the oil shale will result, thereby producing a region of the fragmented mass which cannot be penetrated by retorting gases.

Another reason for monitoring the locus of the combustion and retorting processing zones as they advance through the retort, is to monitor the performance of the retort to determine if sufficient shale oil is being produced for the amount of oil shale being retorted.

Also, by monitoring the locus of the combustion and retorting zones, it is possible to control the advancement of these two zones through the retort at an optimum rate. The rate of advancement of the combustion and retorting zones through the retort can be controlled by varying the flow rate and composition of the combustion zone feed. Knowledge of the locus of the combustion and retorting zones allows optimization of the rate of advancement to produce hydrocarbon products of the lowest cost possible with cognizance of the overall yield, fixed costs, and variable costs of producing the hydrocarbon proucts.

Thus, it is desirable to provide methods for monitoring advancement of combustion and retorting zones through an in situ oil shale retort.

SUMMARY OF THE INVENTION

The present invention concerns a process for determining the locus of a retorting and/or combustion zone as it advances through a fragmented permeable mass of particles containing oil shale in a retort formed in a subterranean formation containing oil shale. More particularly, the present invention comprises the steps of determining, prior to retorting, the content at various levels in the subterranean formation of one or more precursors for at least one selected constitutent formed by advancement of the processing zone during retorting; and, then analyzing the effluent water from the formation during retorting for the presence of at least one such selected constituent.

The precursor can, for example, be the connate water in the oil shale in which case the selected constituent formed by the processing zone would be the effluent water itself, i.e., the amount of water above that produced by such other sources in the retort as leaking ground water and aquifers, processing water introduced into the retort, water produced by oxidation of fuel in the retort inlet mixture, and water produced by oxidation of kerogen. Another precursor suitable for the present invention is the organic nitrogen content of the kerogen in which case the selected constituent can be either ammonia produced by reduction of the nitrogen or ammonium sulfate dissolved in the water.

DRAWINGS

These and other features, aspects and advantages of the present invention will become more apparent upon consideration of the following description, appended claims, and accompanying drawing where the FIGURE represents schematically in vertical cross section an in situ oil shale retort.

DESCRIPTION

Referring to the FIGURE an in situ oil shale retort 10 is in the form of a cavity 12 formed in a subterranean formation 14 containing oil shale. The cavity contains a fragmented permeable mass 16 of formation particles containing oil shale. The cavity 12 can be created simultaneously with fragmentation of the mass of formation particles, such as by blasting by using any of a variety of known techniques. Alternatively, the cavity can be formed by excavating or mining a void within the boundaries of a subterranean in situ oil shale retort site and then explosively expanding the remaining oil shale in the formation toward the void. Methods of forming an in situ oil shale retort are described in U.S. Pat. Nos. 3,661,423, 4,043,595, 4,043,596, 4,043,597, and 4,043,598 the disclosures of which are incorporated herein by reference; a variety of other techniques can also be used.

A conduit 17 communicates with the top of the fragmented mass of formation particles. During the retorting operation a combustion zone is established in the retort 10 by ignition of carbonaceous material in the oil shale. The combustion zone is advanced through the fragmented mass by introducing an oxygen containing retort inlet mixture into the in situ oil shale retort through the conduit 17 as a combustion zone feed. The retort inlet mixture can be air, or air enriched with oxygen, or air diluted by a fluid such as water, steam, a fuel, recycled off gas, an inert gas such as nitrogen, and combinations thereof.

Oxygen introduced to the retort in the retort inlet mixture oxidizes carbonaceous material in the oil shale to produce combustion gas, which, along with any unreacted portion of the combustion zone feed passes through the fragmented mass of particles on the advancing side of the combustion zone to establish a retorting zone on the advancing side of the combustion zone. Kerogen in the oil shale is retorted in the retorting zone to produce liquid and gaseous products.

Oil shale can contain appreciable quantities of compounds containing sulfur which during retorting and combustion can release sulfur. Exemplary of compounds which can be present in oil shale which contain sulfur are iron disulfide, iron sulfide, and potassium hydrogen sulfate. Also, kerogen can contain sulfur.

There is an access tunnel, adit or drift 20 in communication with the bottom of the retort which contains a sump 22 for collection of the liquid products 23, including liquid hydrocarbon products and water. The water may be from a variety of souces, such as ground water and aquifers leaking into the retort, water introduced into the retort for processing purposes, water produced by oxidation of fuel in the retort inlet mixture, water produced by oxidation of kerogen and shale oil, and connate water in the oil shale. An off gas 24 containing gaseous products, combustion gas, carbon dioxide from carbonate decomposition, and any gaseous unreacted portion of the combustion zone feed, is also withdrawn from the in situ oil shale retort 10 by way of the drift 20. The liquid products and off gas are withdrawn from the retort as effluent fluids.

Oil shale typically is horizontally bedded due to its sedimentary nature. Layers in the fragmented mass are correlated with strata in the unfragmented formation because there is little vertical mixing between strata even when they have been explosively fragmented. Therefore, samples of various strata through the retort can be taken before initiating retorting of the oil shale and assays can be conducted to determine content of a selected precursor component such as water or the organic nitrogen content of the kerogen, which can, for example, be determined by Kjeldahl analysis. Such samples can be taken either from within the fragmented mass in the retort site before expansion, or from the formation nearby the fragmented mass since little change in the kerogen content of oil shale or the constituents of the oil shale occurs over large areas of formation.

According to a first aspect of the present invention, the locus of the retorting and/or combustion zones can be determined by analyzing the effluent water from the fragmented mass during retorting for the concentration of a selected constituent contained therein. Monitoring means 38 can be provided for monitoring the water effluent after it has been separated from the shale oil for the presence of a selected constituent such as ammonia, ammonium sulfate, and the like. Suitable monitoring means for ammonia are well known in the art, such as a gas chromatograph or mass spectrometer.

By monitoring water effluent for the concentration of a selected constituent produced from a precursor in the fragmented mass by advancement of a processing zone through the retort, it is possible to determine the locus of the processing zone in that portion of the fragmented mass being processed. This is because the concentration of some constituents in water withdrawn from an in situ oil shale retort can be correlated with the content of a corresponding precursor in the oil shale being processed. For example, the concentration of ammonia in water from an in situ retort can be dependent upon the organic nitrogen content of the kerogen in the oil shale being retorted in the retort.

To take advantage of this correlation, selected elevations of the formation are assayed for content of the precursor or precursors to develop a histogram of content of such a precursor versus elevation in the fragmented mass. As noted above, layers in the fragmented mass are correlated with strata in the unfragmented formation because there is little vertical mixing between strata when explosively fragmenting to form a fragmented permeable mass of formation particles. Samples for assay can be taken from within the fragmented mass, from formations within the retort site before explosive expansion, and/or from formations nearby the fragmented mass. From the samples and the correlation between the concentration of the selected constituent in the effluent water and the content of the corresponding precursor in the formation, the content of the constituent in the effluent water can be predicted as a function of the elevation of the processing zone in the fragmented mass.

As used herein, the term "content" is used to refer to either the total amount or the concentration of a precursor in the formation, or to either the total amount or the concentration of a constituent in the effluent water.

By way of review there are four steps to determine the elevation of a processing zone in an in situ oil shale retort. First, the formation is assayed at selected elevations for a precursor of a constituent in the effluent water; at least two and preferably more elevations should be sampled to give meaning to the resultant data. Then, using a correlation between the concentration of the selected constituent in the effluent water and the content of the precursor in the oil shale being processed, the concentration of the constituent in the effluent water is predicted. Third, the actual concentration of the selected constituent in the effluent water is determined. Finally, the predicted concentration and the actual concentration of the constituent in the effluent water are compared. Thus, by knowing the content of a precursor in the fragmented mass 16 at selected elevations, by knowing the correlation between content of a precursor in the fragmented mass and concentration of the selected constituent in the effluent water, and by knowing the actual concentration of the selected constituent in the effluent water, the elevation of a processing zone in the retort can be determined.

A variety of precursor:constituent pairs can be used for determining the locus of a processing zone advancing through a retort. Exemplary of precursor:constituent pairs are nitrogen: ammonia, nitrogen:ammonium sulfate, metals such as calcium, magnesium, sodium and potassium usually found in the form of carbonates and their corresponding hydroxides, e.g., calcium carbonate:calcium hydroxide and magnesium carbonate:magnesium hydroxide.

Nitrogen:ammonia and nitrogen:ammonium sulfate are preferred precursor:constituent pairs because there is a reasonably good correlation between the nitrogen content of the kerogen in the oil shale and the ammonia and ammonium sulfate content of effluent water. In addition, the formation is usually assayed for kerogen content before preparing an in situ oil shale retort regardless of any need to determine the locus of the processing zone as a means of making sure that the formation contains sufficient recoverable kerogen to justify the cost of formation and processing of a retort. Therefore, using nitrogen:ammonia or nitrogen:ammonium sulfate as the precursor:constituent pair results in little, if any, additional cost.

According to another aspect of the instant invention, it is possible to locate a processing zone in the fragmented mass of a subterranean formation by monitoring the actual production of water and comparing it with previously determined predicted rates for various levels of the formation. Different strata of oil shale in a retort contain, in addition to varying contents of kerogen, varying contents of water. Generally, the higher the Fischer Assay of the oil shale, which is a measure of the number of gallons of shale oil recoverable from a ton of oil shale, the greater the water content.

To take advantage of this correlation selected elevations of the formation can be sampled and assayed for their water content. A histogram of water content versus elevation in the fragmented mass can then be prepared and predictions made as to water production from each of the levels in the processing zone. Actual water production can then be compared with predicted water production and the processing zone located. In this case, actual water production is the amount discharged from the retort as either liquid or vapor in excess of the quantity which can be traced to such other sources as ground water and aquifers leaking into the retort, process water intentionally introduced into the retort, and water produced by oxidation of either fuel or kerogen.

Not only can the method of this invention be used for determining the elevation of a processing zone in a fragmented permeable mass in a retort and for detecting deviations from a desired or predicted elevation, it can also be used to determine the orientation of the processing zone. If a processing zone is substantially flat and horizontal, it encounters layers of different content of kerogen relatively abruptly. Thus, changes in ammonia concentration or water production can clearly be associated with changes in kerogen content. If the retorting zone is skewed or significantly warped, it can encounter several layers of different kerogen content at substantially the same time, thereby tending to obscure the correlation between ammonia concentration or water production and the location of the retorting zone in the fragmented mass. In essence, the first derivative of ammonia concentration or water production as a function of time is reduced when the retorting zone is skewed or non-planar as compared with the first derivative of the ammonia concentration or water production when the retorting zone is substantially flat and horizontal. Thus, it is possible to determine if the retorting zone is substantially planar and substantially normal to its direction of advancement by comparing the first derivative of determined ammonia content of the effluent water with the first derivative of predicted ammonia content or the first derivative of water production rate with the first derivative of the predicted water production rate, respectively.

Although this invention has been described in detail with reference to certain versions thereof, other versions of this invention can be practiced. Therefore, the spirit and scope of the appended claims should not be limited to the description of the preferred versions contained herein.

What is claimed is:

1. A method for determining the locus of a processing zone as it advances through a fragmented permeable mass of particles containing oil shale in an in situ oil shale retort formed in a subterranean formation containing oil shale, the retort having boundaries of unfragmented formation, comprising the steps of assaying the subterranean formation at selected locations for the content of at least one precursor for at least one selected constituent resulting from advancement of the processing zone through the formation;

predicting the concentration of the selected constituent in effluent water from the retort due to processing of the fragmented mass in at least a portion of such locations;

monitoring the effluent water withdrawn from the fragmented mass during retorting for the presence of the selected constituent; and, correlating the concentration of the selected constituent with such predicted concentrations for determining the locus of the processing zone in the retort.

2. The method of claim 1 wherein the connate water content of the oil shale particles in the fragmented mass comprises the precursor and water production from the fragmented mass is monitored.

3. The method of claim 1 wherein the processing zone is a combustion zone.

4. The method of claim 1 wherein the processing zone is a retorting zone.

5. The method of claim 1 wherein the organic nitrogen content of kerogen in the oil shale particles in the formation is the precursor.

6. The method of claim 5 wherein the selected constituent is ammonia.

7. The method of claim 1 wherein the selected constituent is ammonium sulfate.

8. The method of claim 1 wherein the precursor is calcium carbonate and the selected constituent is calcium hydroxide.

9. The method of claim 1 wherein the precursor is magnesium carbonate and the selected constituent is magnesium hydroxide.

10. The method of claim 1 wherein the precursor is sodium carbonate and the precursor is sodium hydroxide.

11. The method of claim 1 wherein the precursor is potassium carbonate and the precursor is potassium hydroxide.

12. A method for determining the locus of a processing zone advancing through a fragmented permeable mass of particles containing oil shale in an in situ oil shale retort in a subterranean formation containing oil shale, the retort having boundaries of unfragmented formation and the retort having an effluent water passing therefrom containing a selected constituent, the selected constituent being formed from at least one precursor contained in the formation by advancement of the processing zone through the fragmented mass, the method comprising the steps of:

determining the content of such a precursor in the formation at selected locations in the retort before processing the selected locations;

predicting the concentration of the selected constituent in effluent water from the retort due to processing of the fragmented mass in at least a portion of such locations;

monitoring the effluent water from the retort for the content of the selected constituent; and, correlating the concentration of the selected constituent with such predicted concentrations for determining the locus of the processing zone in the retort.

13. The method of claim 12 wherein the organic nitrogen content of the kerogen in the formation is determined and the selected constituent is ammonia.

14. The method of claim 12 wherein the processing zone is a combustion zone.

15. The method of claim 12 wherein the processing zone is a retorting zone.

16. The method of claim 12 wherein the organic nitrogen content of the kerogen in the formation is determined and the selected constituent is ammonium sulfate.

17. The method of claim 12 wherein the precursor is selected from the group consisting of calcium carbonate, magnesium carbonate, sodium carbonate and potassium carbonate.

18. The method of claim 12 wherein the selected constituent is selected from the group consisting of calcium hydroxide, magnesium hydroxide, sodium hydroxide and potassium hydroxide.

19. The method of claim 12 wherein the step of determining comprises assaying a portion of the formation which is outside the boundaries of the retort.

20. The method of claim 12 wherein the step of determining comprises assaying a portion of the formation which is within the boundaries of the retort.

21. A method for determining the locus of a processing zone advancing through a fragmented permeable mass of particles containing oil shale in an in situ oil shale retort in a subterranean formation containing oil shale, the retort having boundaries of unfragmented formation, the formation containing connate water, the retort having an effluent water passing therefrom containing connate water released from the formation, the method comprising the steps of:

determining connate water content in the formation at selected locations in the retort before processing the selected locations; and monitoring the quantity of effluent water discharged from the retort.

22. The method of claim 21 wherein the processing zone is a retorting zone.

23. The method of claim 21 wherein the step of determining comprises assaying a portion of the formation which is outside the boundaries of the retort.

24. The method of claim 21 wherein the step of determining comprises assaying a portion of the formation which is within the boundaries of the retort.

25. A method for determining the locus of a processing zone advancing through a fragmented permeable mass of particles containing oil shale in an in situ oil shale retort in a subterranean formation containing oil shale, the retort having boundaries of unfragmented formation, the oil shale containing nitrogen, the retort having an effluent water passing therefrom comprising the steps of determining the nitrogen content in the formation at selected locations in the retort before processing the selected locations;

predicting the concentration of at least one nitrogen-containing compound formed from the nitrogen in the oil shale in effluent water from the retort due to processing of the fragmented mass;

monitoring effluent water discharged from the retort for the content of said at least one nitrogen-containing compound; and, correlating the concentration of the said at least one nitrogen-containing compound with such predicted concentrations for determining the locus of the processing zone.

26. The method of claim 25 wherein the processing zone is a retorting zone.

27. The method of claim 25 wherein the step of determining comprises assaying a portion of the formation which is outside the boundaries of the retort.

28. The method of claim 25 wherein the step of determining comprises assaying a portion of the formation which is within the boundaries of the retort.

29. The method of claim 25 wherein the nitrogen containing compound is ammonia.

30. The method of claim 25 wherein the nitrogen containing compound is ammonium sulfate.

* * * * *